US006684834B2

(12) United States Patent
Kohrs

(10) Patent No.: US 6,684,834 B2
(45) Date of Patent: Feb. 3, 2004

(54) DEVICE TO CHANGE THE TIMING OF GAS EXCHANGE VALVES IN AN INTERNAL COMBUSTION ENGINE, IN PARTICULAR A ROTATING PISTON POSITIONING DEVICE TO ADJUST THE ANGLE THAT A CAMSHAFT IS ROTATED RELATIVE TO A CRANKSHAFT

(75) Inventor: Mike Kohrs, Herzogenaurach (DE)

(73) Assignee: INA-Schaeffler KG, Herzogenaurach (DE)

( * ) Notice: Subject to any disclaimer, the term of this patent is extended or adjusted under 35 U.S.C. 154(b) by 0 days.

(21) Appl. No.: 10/195,577

(22) Filed: Jul. 15, 2002

(65) Prior Publication Data

US 2003/0037741 A1 Feb. 27, 2003

(30) Foreign Application Priority Data

Jul. 14, 2001 (DE) ..... 101 34 320

(51) Int. Cl.[7] ..... F01L 1/34

(52) U.S. Cl. ..... 123/90.17; 123/90.15; 464/160; 251/12

(58) Field of Search ..... 123/90.15, 90.16, 123/90.17, 90.18; 464/1, 2, 160; 251/12

(56) References Cited

U.S. PATENT DOCUMENTS 5,592,909 A * 1/1997 Tsuruta ..... 123/90.17
5,794,578 A * 8/1998 Strauss et al. ..... 123/90.17
5,823,152 A * 10/1998 Ushida ..... 123/90.17
6,363,896 B1 * 4/2002 Speier ..... 123/90.17
6,382,154 B2 * 5/2002 Dietz et al. ..... 123/90.17

FOREIGN PATENT DOCUMENTS

DE 19623818 A1 12/1996
DE 19961567 A1 7/2001

* cited by examiner

*Primary Examiner*—Thomas Denion
*Assistant Examiner*—Ching Chang
(74) *Attorney, Agent, or Firm*—Volpe and Koenig, P.C.

(57) ABSTRACT

A rotating piston positioning device to adjust the angle of rotation of a camshaft with respect to a crankshaft of an internal combustion engine. The device includes a drive member (5) that is driven by the crankshaft and a driven member (10) that is fixed to the camshaft (4). At least the driven member (10) of the device (1) is formed of a lightweight metal and is bolted to the camshaft (4) by a central fastening screw (13), whereas the drive member (5) is radially supported external to the driven member (10) and transfers force to the driven member by at least two hydraulic pressure chambers located inside the device (1). The conical zone of force from the fastening screw (13) to the driven member (10) is carried by a special collar (16) made of a compression-resistant material that at the same time is a prefabricated pressure medium distributor of the device (1). The driven member (10) is shape-locked and/or friction locked to this collar axially, radially and circumferentially, and is bolted together with it to the camshaft (4) without deforming.

9 Claims, 4 Drawing Sheets

DEVICE TO CHANGE THE TIMING OF GAS EXCHANGE VALVES IN AN INTERNAL COMBUSTION ENGINE, IN PARTICULAR A ROTATING PISTON POSITIONING DEVICE TO ADJUST THE ANGLE THAT A CAMSHAFT IS ROTATED RELATIVE TO A CRANKSHAFT

BACKGROUND

This invention pertains to a device to change the timing of gas exchange valves in an internal combustion engine, and it is particularly advantageous to implement in rotating piston positioning devices with a lightweight design that are used to adjust the angle that a camshaft is rotated relative to a crankshaft.

A device to change the timing of gas exchange valves in an internal combustion engine is known from DE 196 23 818 A1, with this device defining a class and being designed as a rotating piston positioning device to adjust the angle that a camshaft is rotated relative to a crankshaft, with the device having a lightweight design, and being located at the drive end of a camshaft that is held in the cylinder head of the internal combustion engine. In principle, this device, also identified as a tilting-vane positioner, is designed as a hydraulic actuator that can be controlled in response to various operating parameters of the internal combustion engine, and is formed essentially of a drive member that is driven by a crankshaft of the internal combustion engine and a driven member that is fixed to the camshaft of the internal combustion engine. The drive member is made up of a drive pulley that contains at least two hydraulic working chambers formed within a hollow cylindrical lightweight metal stator with at least two intermediate radial walls, including two ferrous metal sidewalls. In contrast to this, the driven member in this device is provided in the form of a vane wheel formed in its entirety of a lightweight metal bolted axially to the camshaft by means of a central fastening screw. The vanes of this vane wheel extend radially into the working chambers of the drive pulley and divide each of the chambers into two opposing hydraulic pressure chambers. The drive member rotates external to the driven member, i.e. on the end of the camshaft and on the head of the central fastening screw. It transfers force to the driven member by means of the hydraulic pressure chambers formed within the device in such a way that by selectively or simultaneously charging these pressure chambers with a pressure medium, the driven member is rotated relative to, or fixed with respect to, the drive member. Consequently, the camshaft is rotated relative to the crankshaft.

However, a disadvantage to this known device is that the driven member, which is made of a lightweight metal, must be bolted to the camshaft with a high torque from the central fastening screw so as to transfer the drive torque effected by the crankshaft of the internal combustion engine through the drive member to the driven member and effectively to the camshaft. However, in a driven member made of a lightweight metal or a plastic, high torques lead to detrimental compressive deformations and high stresses, mainly in the conical zone of force at the fastening screw, such that the driven member can only be bolted to the camshaft using low torques to avoid these compressive deformations and stresses. Thus, the driven member is only suitable for transferring small drive torques or chain forces to the camshaft. Transfer of higher drive torques or chain forces to the camshaft is only possible by increasing the friction between the driven member and the camshaft with the help of expensive coatings or surface treatments, or by using additional shape-locking elements at the contact surfaces, which are expensive as well. Even if the driven member is bolted with a higher torque to the camshaft so as to transfer high drive torques, the larger radial and axial play between the drive member and the driven member in the device, which are necessary due to the compressive deformations and the high stress, have the disadvantage that in addition to the increased danger of seizing, and thus the possibility of failure of the device, increased leakage of pressure medium occurs within the device that negatively influences the positioning speed and its ability to hold its angle. Moreover, a general disadvantage of the known device designed as a tilting-vane positioner is that the hole pattern for the pressure medium channels feeding the pressure chambers of the device, said pattern to be incorporated into the device's driven member, which for the most part is designed as a one-piece tilting vane wheel, is technically complicated to manufacture, relatively speaking. Also, it is relatively difficult to brace by hand against the torque applied to the fastening screw when installing the driven member onto the camshaft.

SUMMARY

It is therefore the object of this invention to provide a device to change the timing of gas exchange valves in an internal combustion engine, in particular a rotating piston positioning device to adjust the angle that a camshaft is rotated relative to a crankshaft, with the device having a driven member made of a lightweight metal or a plastic and that can be bolted to the camshaft using a central fastening screw, and the driven member being provided such that the frictional lock between it and the camshaft is increased so as to transfer higher drive torques to the camshaft without resulting in compressive deformations and high stresses or having to implement expensive measures, and wherein said driven member is characterized by a simplified means of manufacturing the pressure medium channels that feed the pressure chambers of the device and is characterized by a simple way to brace against the torque applied to the fastening screw.

According to the invention, this object is met by a device in which the conical zone of force from the fastening screw to the driven member is designed into a special collar made of a compression-resistant material on which the driven member can be locked axially, radially and circumferentially by means of shape-locking or by friction, and through which the driven member can be bolted to the camshaft without deforming.

A useful further development of the device according to the invention is for the collar positioned within the driven member to preferably be made of a steel material or similar high strength material, and at the same time for it to be a prefabricated pressure medium distributor containing the pressure medium channels leading from the pressure medium feed and discharge ports of the device to their associated pressure chambers. However, it is also possible to use the collar positioned within the driven member for the exclusive purpose of preventing compressive deformations and stresses and to allocate the function of pressure medium distribution to the camshaft and to the device.

Another feature of the device according to the invention is that the collar has ends that extend beyond the axial width of the device and that its exterior surface beyond the driven member forms the external radial bearing of the drive member. Using steel covers as side walls for the driven member, one of which can at the same time be designed as a chain pulley or a belt pulley, each cover having a center hole that fits over the collar, higher bearing forces can be withstood by the radial bearings. At the same time, it is no longer possible for thermally caused changes to occur in the bearing play between the drive member and the driven member, thanks to the materials being the same. Moreover, it is advantageous to, at the same time, design the extended ends of the collar to have a means at one end to brace against the torque applied to the fastening screw and a means at the other end to center the device on the camshaft. This enables the transfer of higher drive forces from the crankshaft to the camshaft by means of the driven member by increasing the torque on the fastening screw, as well as enables the exact positioning of the device on the camshaft. However, an alternative option here is to design the collar without extended ends and to form the external radial bearing of the driven member by the exterior surfaces of the head of the fastening screw and the end of the camshaft, for example.

One preferred embodiment of the device according to the invention is further characterized in that the driven member of the device is locked frictionally onto the collar radially and circumferentially by means of a press fit. By providing the press fit with close tolerances accordingly, the driven member is also fixed axially to the collar, which obviates the need to take further measures to prevent axial shifting of the driven member. When there are larger axial forces present, however, it is advantageous to axially secure the driven member in addition between a shoulder of the collar, created by enlarging its diameter, and a camshaft shoulder that sits flush against the rear of the drive member. In this way, the driven member, which is bolted together with the collar to the camshaft, sits directly against the shoulder of the collar and thus cannot be axially shifted away from the camshaft, whereas on the other side, it sits against the inside of one side of the drive member with play. Due to the fact that the rear camshaft shoulder reaches into a step formed by widening the diameter on the outside of the hole for the radial bearing of this side cover, the driven member is also axially secured in the direction facing the camshaft. However, instead of securing it axially this way, it is possible to insert a radial locking pin into a radial hole that passes through the driven member into the collar, said locking pin also securing the driven member in the peripheral direction.

In another feature characteristic of the first embodiment of the device according to the invention, two annular notches connected to the pressure chambers of the device are located on the exterior surface of the collar, separated axially from one another, and two annular notches connected to the pressure medium feed and discharge ports of the device are located axially on the exterior surface of the camshaft and separated from one another. The first of these annular notches, respectively, are hydraulically connected by means of a number of axial notches in the exterior surface of collar and the latter of these annular notches, respectively, are hydraulically connected by means of the axial center hole of the collar. In this manner, the annular and axial notches in the collar are designed as pressure medium channels prefabricated into the drive member and collar in a simple manner before they are installed, thus simultaneously providing the collar as a pressure medium distributor for the device and being economical to manufacture. At the same time, this simplifies the manufacture of the pressure medium channels to be incorporated into the driven member of the device. This is because it is only necessary to design the driven member to include radial holes leading from the pressure chambers of the device to the annular notches in the collar. The pressure medium feed and discharge ports of the device are, moreover, formed in a known manner using a radial camshaft bearing located in the cylinder head and that is connected to the lubricant circuit of the internal combustion engine, or by means of a special pressure medium console at the cylinder head of the internal combustion engine also connected to the lubricant circuit of the internal combustion engine. Each of these methods seals off the annular notches in the exterior surface of the camshaft, with the notches being connected to the axial notches or to the center hole in the collar through a number of radial holes.

Finally, the first embodiment of the device according to the invention has, in an additional advantageous configuration, the feature in that the end of the collar opposite the camshaft preferably has a hexagonal head upon which to place an auxiliary tool as a means to brace against the torque applied to the fastening screw. On the other hand, the end of the collar facing the camshaft can act as a means in itself to center the device on the camshaft, being inserted into a complementary centering hole in the rear of the camshaft. This hexagonal head at the end of the collar opposite the camshaft, against which the head of the central fastening screw of the device sits, makes it possible to apply an opposing manual force against the torque arising when bolting the device to the camshaft, and do so in a simple manner using a box wrench or open-face wrench, for example. This prevents transferring the torque to the device. Instead of a hexagonal head, however, it is also possible to design the end of the collar to have just a simple width sufficient for an open-end wrench or to have holes in the rear for a spanner wrench, or to have a notch for a hook wrench. The end of the collar facing the camshaft that provides for the exact centering of the device on the camshaft is inserted into a centering hole incorporated into the rear of the camshaft, the inner diameter of which is approximately the same as the outer diameter of the end of the collar facing the camshaft. In an advantageous manner, the depth of this centering hole is, moreover, dimensioned such that its inner wall, together with the inner wall of the central hole in the side cover of the drive member for the radial bearing, said side cover sitting against the camshaft, seals, against external fluid leaks, the axial notches incorporated into the exterior surface of the collar provided to convey the pressure medium.

In contrast, a second preferred embodiment of the device according to the invention, is characterized in that the driven member of the device is shape-locked onto the collar radially and circumferentially by means of peripheral splining. The driven member is axially secured to the collar preferably by means of a radial locking pin that is inserted into a radial hole that passes through the driven member into the collar. However, instead of using splining as a shape-locked connection between the driven member and the collar in the radial and peripheral direction, it is also conceivable to use a splined shaft, polygon or notch-spring connection that is axially secured either likewise by means of a radial locking pin or, similar to the first embodiment of the device according to the invention, by a shoulder on the collar created by an increase in diameter and a shoulder at the rear of the camshaft. It is, however, also possible to fasten the driven member to the collar permanently both axially as well as radially by gluing it or welding it, or by plastic injection molding using at least one peripheral notch in the collar.

In this embodiment of the device according to the invention, the collar is further designed, simultaneously, as a pressure medium distributor for the device, preferably by locating two annular notches connected to the pressure chambers of the device and two annular notches connected to the pressure medium feed and discharge ports, respectively, on the exterior surface of the collar and axially separated from one another. The former of these annular notches are hydraulically connected through a number of axial holes in the collar and the latter annular notches are hydraulically connected through the axial center hole of the collar. The annular notches and axial holes in the collar as well as the radial holes extending outward from the annular notches are designed as pressure medium channels prefabricated in a simple manner before the drive member and collar are installed. This reduces, in an economical manner, the number of pressure medium channels that must be made in the driven member into radial holes leading from the annular notches in the collar to the pressure chambers of the device. Moreover, in this embodiment, the pressure medium feed and discharge ports of the device are also formed in a known manner using a radial camshaft bearing located in the cylinder head and that is connected to the lubricant circuit of the internal combustion engine, or using a special pressure medium console at the cylinder head of the internal combustion engine, likewise integrated into the lubricant circuit of the internal combustion engine. Each of these methods seals the annular notches in the exterior surface of the collar located outside the device.

Finally, another features of the second embodiment of the device according to the invention is, as in the first embodiment, that the end of the collar opposite the camshaft, against which the head of the central fastening screw of the device also sits, is preferably provided with a hexagonal head to which an auxiliary tool can be attached, for example a box wrench or open-face wrench, to apply a manual force to the driven member that opposes the torque that arises when the device is bolted to the camshaft, as well as to exactly position the device on the camshaft. In this embodiment as well, instead of a hexagonal head, it is also possible to provide the end of the collar to simply have a flat width sufficient for an open-end wrench or to have holes in the back for a spanner wrench, or to have a notch for a hook wrench. In contrast, however, in this embodiment, the end of the collar facing the camshaft has, as a means to precisely center the device on the camshaft, an additional stem with a reduced diameter that is inserted into a complementary centering hole in the rear of the camshaft. The inner diameter of the centering hole in the camshaft, again, is approximately the same as the outer diameter of the centering stem on the collar. However, the axial length of the centering stem is shorter than the depth of the centering hole in the camshaft so as to prevent axial redundancy.

Thus, both embodiments described above of the device according to the invention to change the timing of gas exchange valves in an internal combustion engine, in particular a rotating piston positioning device to adjust the angle that a camshaft is rotated relative to a crankshaft, have the advantage when compared to known devices from the prior art in that by centering a steel collar in the driven member, which is made of a lightweight metal or a plastic, compressive deformations or high stresses can no longer occur as a result of installation torque, above all in the conical zone of force from the central fastening screw. This makes it possible to make use the driven member of the device, which is made of a lightweight design without expensive means, to increase the frictional lock between it and the camshaft so as to transfer higher drive torques or chain forces originating from the crankshaft of the internal combustion engine from the drive member to the driven member. The design can also include common amounts of radial and axial play with respect to the drive member of the device so as to minimize the pressure medium leakage within the device. Another advantage of the device designed according to the invention is that the special steel collar can simultaneously be prefabricated with the numerous pressure medium channels leading from the pressure medium feed and discharge ports of the device to their pressure chambers, thus considerably reducing the manufacturing cost and the costs of the device as a whole. By axially lengthening the steel collar beyond the width of the device, there are the added advantages in that, for one thing, the exterior surface of the collar can be used both as an external radial bearing for the drive member having a much higher bearing strength than lightweight metal or plastic stems. Additionally, to facilitate the installation of the device, the ends of the collar can be provided on one end to provide a brace against the torque applied to the fastening screw and on the other end with a means to center the device on the camshaft.

BRIEF DESCRIPTION OF THE DRAWINGS

This invention is explained in more detail below on the basis of the two preferred embodiment and is shown schematically in the associated drawings. In the drawings.

DETAILED DESCRIPTION OF THE PREFERRED EMBODIMENTS

Figure 1:
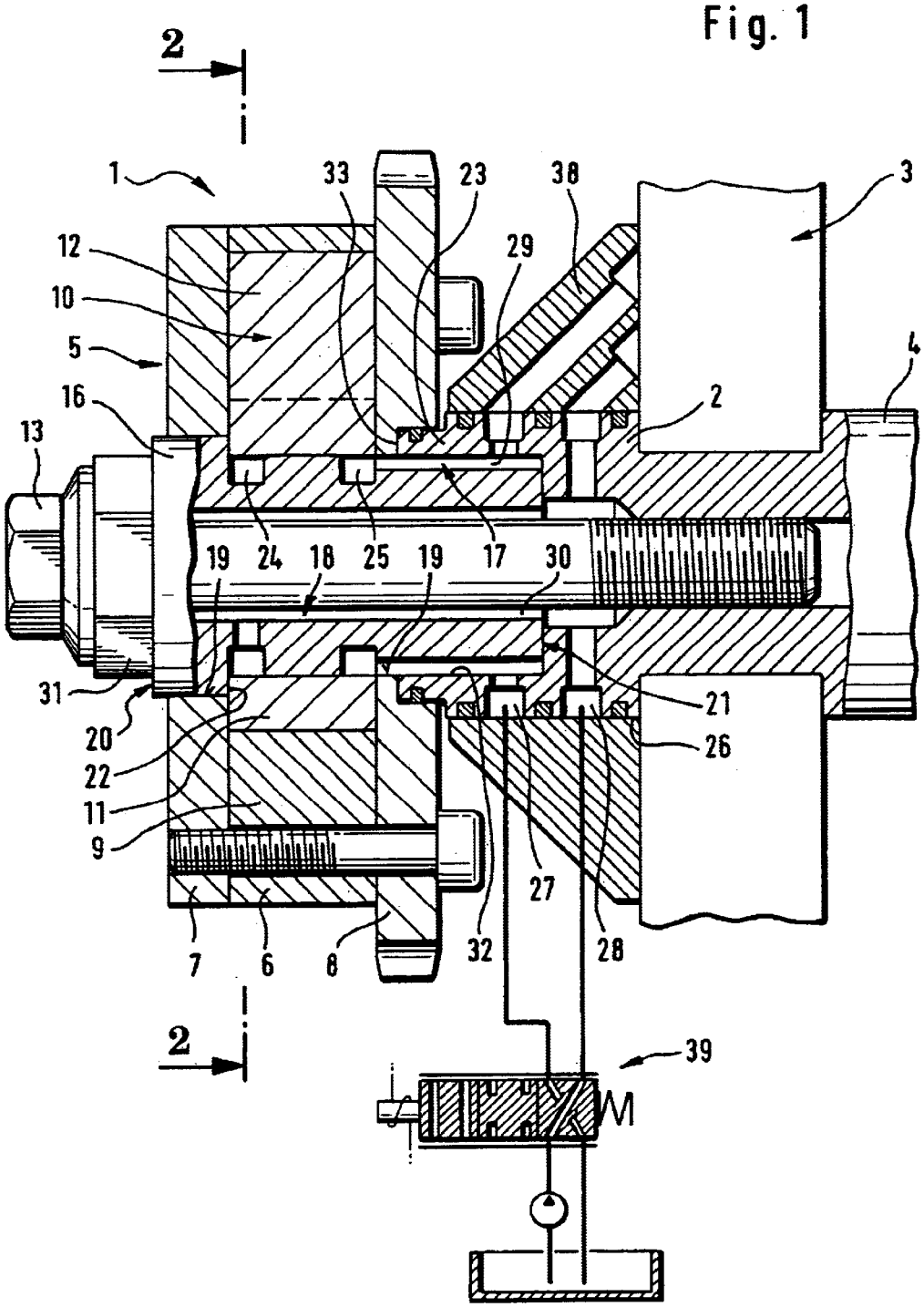
FIG. 1 is a longitudinal cross-sectional view through a device according to the first preferred embodiment of the invention taken along line 1—1 in FIG. 2.
Figure 2:
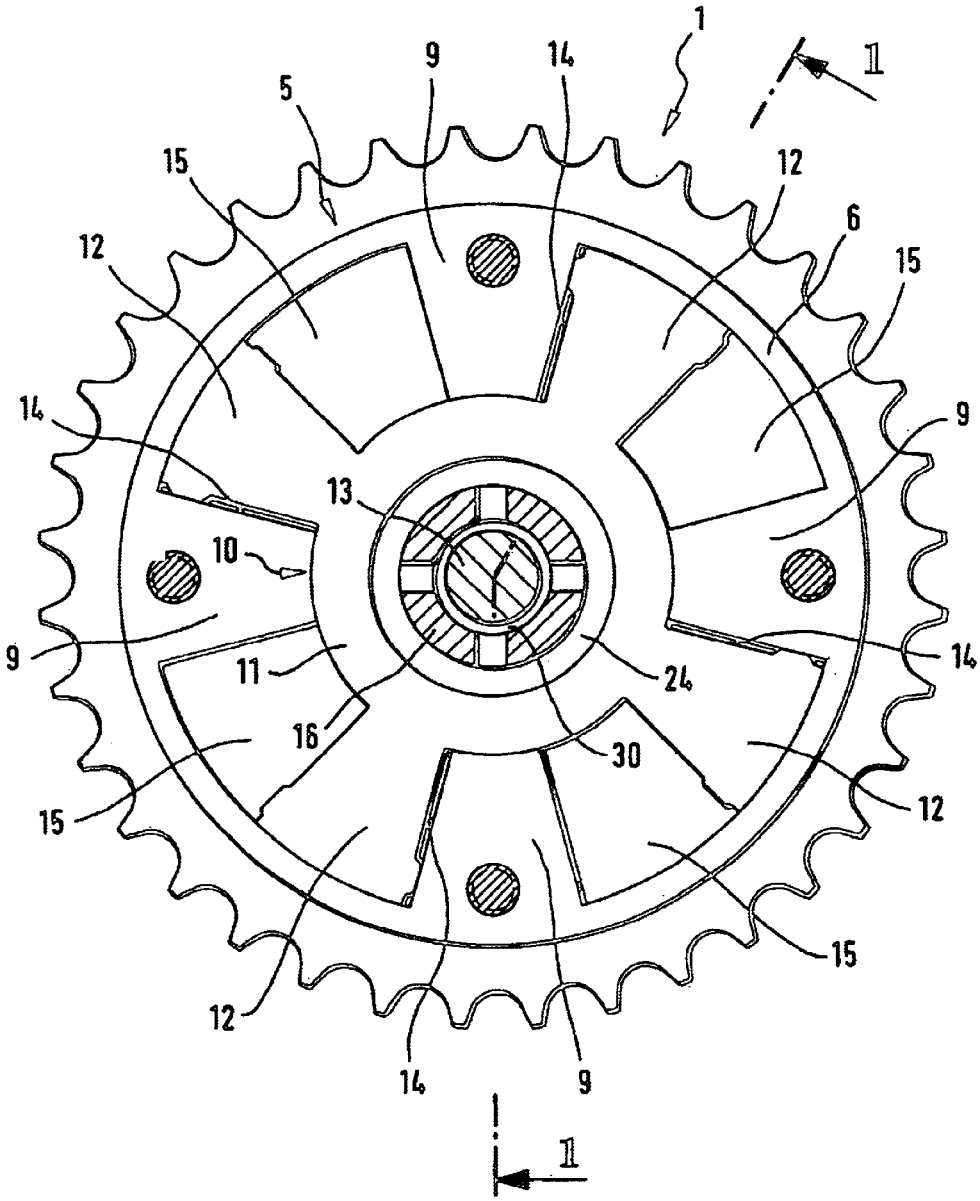
FIG. 2 is a cross-sectional through the device according to the first preferred embodiment of the invention taken along line 2—2 in FIG. 1.
Figure 3:
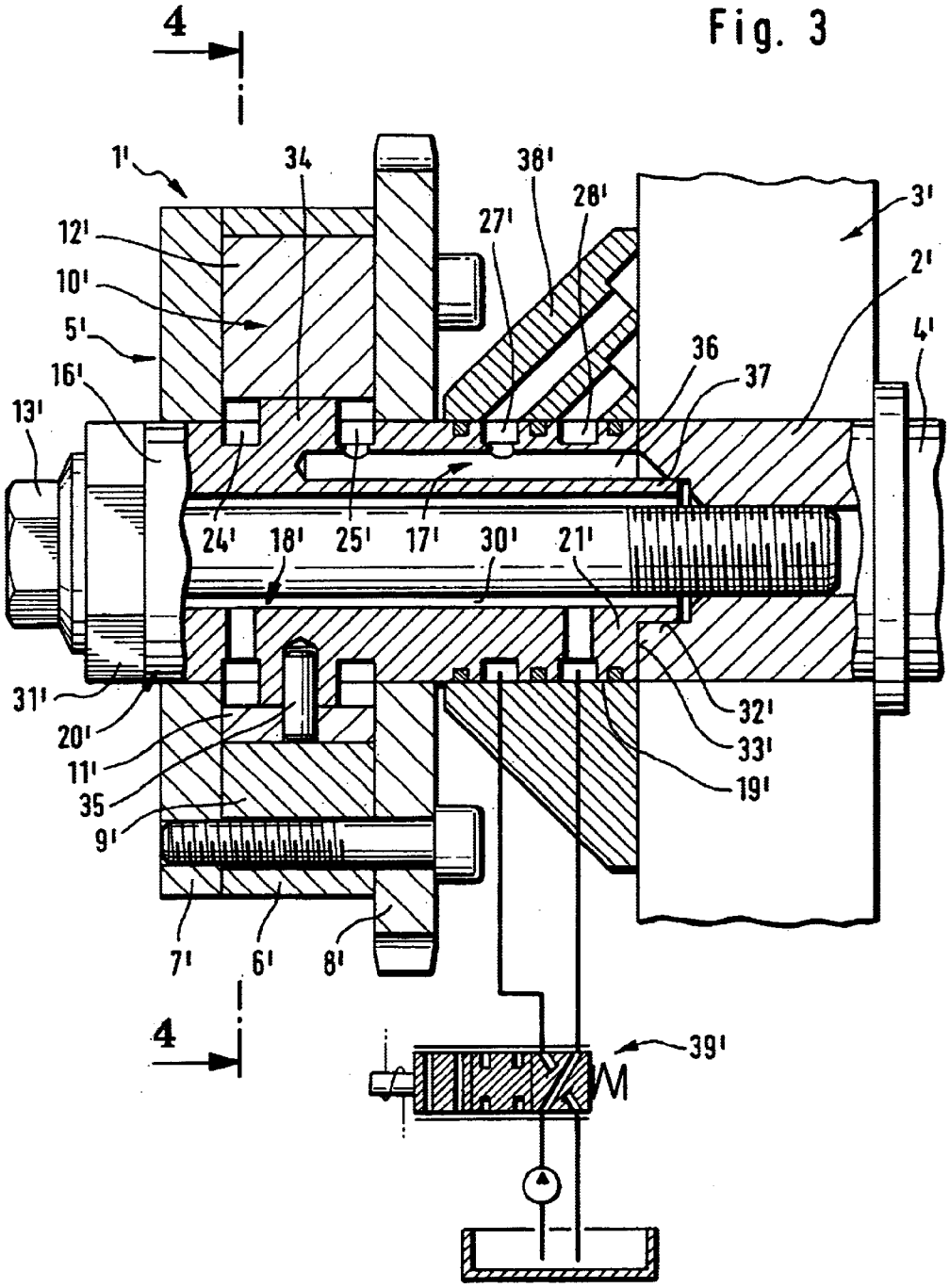
FIG. 3 is a longitudinal cross-sectional of a device according to the second preferred embodiment of the invention taken along line 3—3 in FIG. 4.
Figure 4:
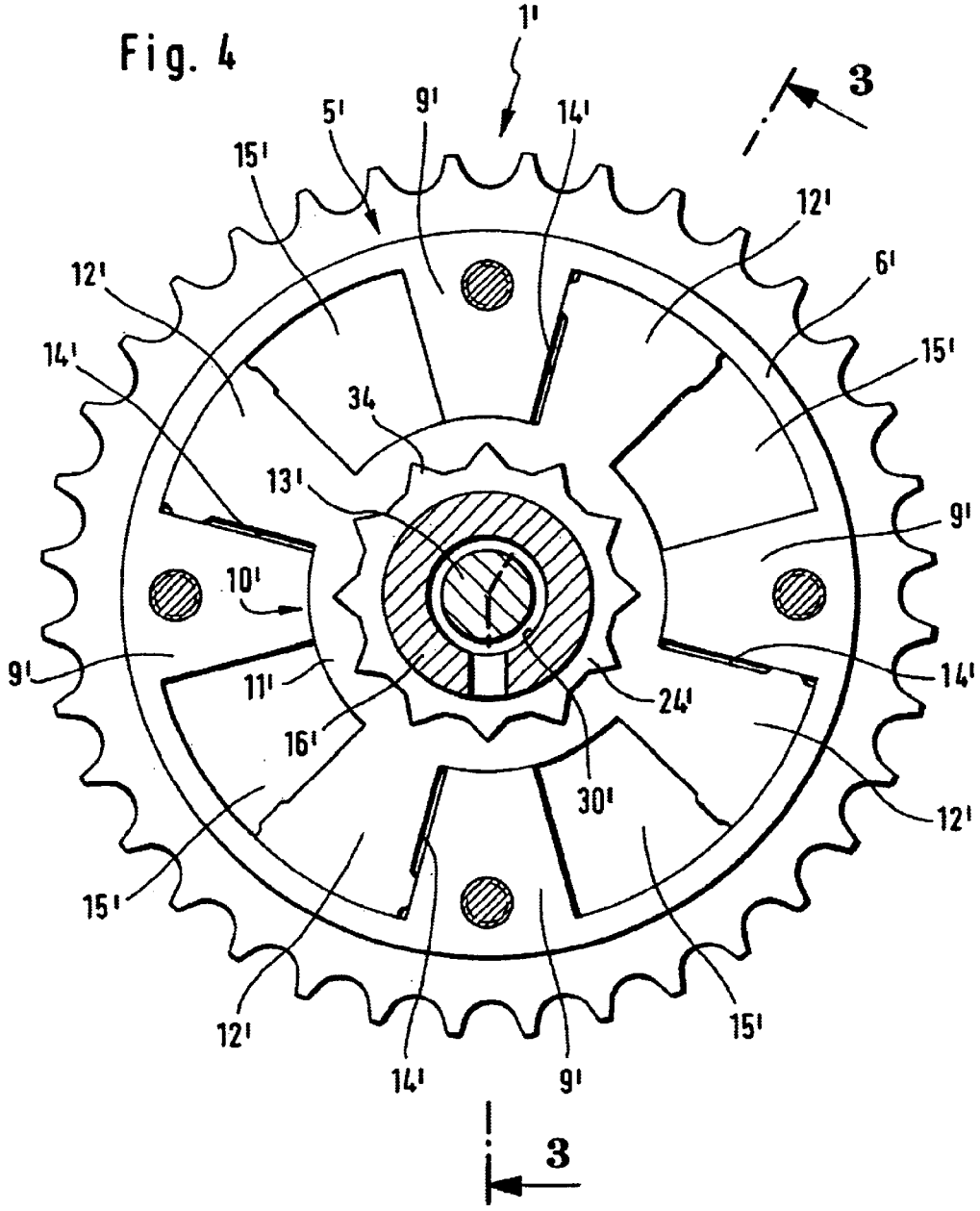
FIG. 4 is a cross-sectional view through the device according to the second preferred embodiment of the invention taken along line 4—4 in FIG. 3.

FIGS. 1 and 2 and FIGS. 3 and 4 depict two different embodiments of a device 1 or 1' to change the timing of gas exchange valves in an internal combustion engine, each of which is designed as a rotating piston positioning device to adjust the angle of rotation of a camshaft 4 or 4' with respect to a crankshaft, which is not shown. Both devices 1, 1' are located at the driven end 2, 2' of the camshaft 4, 4', which is held inside the cylinder head 3, 3' of the internal combustion engine. Also, both devices are designed, in principle, as a hydraulic actuator that can be controlled in response to various operating parameters of the internal combustion engine. In particular, FIGS. 2 and 4 illustrate that the actual design of the devices 1, 1' is in the form of a tilting-vane positioner that is formed essentially of a drive member 5, 5' that is driven by the crankshaft of the internal combustion engine and of a driven member 10, 10' that is fixed to the camshaft 4, 4' of the internal combustion engine. In these devices 1, 1', the drive member 5, 5' is made up of a hollow cylindrical peripheral wall 6, 6' and two side walls 7, 8 and 7', 8', respectively, each of which is made of a ferrous metal and the two of which when bolted together form a cavity that is subdivided into four sections by means of four intermediate walls 9, 9' that extend radially inward from the peripheral wall 6, 6'. On the other hand, the driven member 10, 10' of the devices 1, 1' are formed as a vane wheel made of a lightweight metal. Four vanes 12, 12' extend radially from its hub 11, 11' into the sections formed in the drive member 5, 5', subdividing each section into two hydraulic pressure chambers 14, 15 and 14', 15', respectively. Due to the lightweight design of the driven member 10, 10', which is axially bolted to the camshaft 4, 4' using a central fastening screw 13, 13', the drive member 5, 5' is supported radially external to the driven member 10, 10' as it rotates, and force is transferred from it to the driven member through the hydraulic pressure chambers 14, 15 and 14', 15', respectively, that are formed inside the device 1, 1'. This force transfer is such that when the pressure chambers 14, 15 and 14', 15', respectively, are selectively or simultaneously charged with a hydraulic pressure medium, the driven member 10, 10' makes a rotation relative to or is fixed with respect to the drive member 5, 5'. This causes the camshaft 4, 4' to do likewise with respect to the crankshaft.

Furthermore, as shown in particular in FIGS. 1 an 2 in both devices 1, 1' according to this invention, the conical zone of force from the fastening screw 13, 13' is transferred by a special collar 16, 16' made of a compression-resistant material so as to prevent compressive deformations when the driven member 10, 10', which is made of a lightweight metal, when it is fastened to the camshaft 4, 4' using the central fastening screw 13, 13'. The driven member 10, 10' is shape-locked and/or friction-locked onto this collar axially, radially and circumferentially, and an be bolted to the camshaft 4, 4' without deforming. At the same time, the special collar 16, 16' is designed as a prefabricated pressure medium distributor of the device 1, 1', containing the majority of the pressure medium channels 17, 18 and 17', 18', respectively, that lead from the pressure medium feed and discharge ports of the device 1, 1' to the pressure chambers 14, 15 and 14', 15', respectively, of the device. The collar 16, 16' located in the driven member 10, 10' is advantageously provide as a steel collar, whose exterior surface 19, 19' serves at the same time as the external radial bearing for the side walls 7, 8 and 7', 8', respectively, of the driven member 5, 5'. In addition, the ends 20, 21 and 20', 21', respectively, of the collar 16, 16' extended beyond the axial width of the device 1, 1' and have on one side a means to brace against the torque applied to the fastening screw 13, 13' and on the other side a means to center the device 1, 1' on the camshaft 4, 4'.

In the first embodiment of the device 1 according to the invention shown in FIGS. 1 and 2, the implementation of these features is accomplished by frictionally locking the driven member 10 onto the collar 16 radially and circumferentially by a press fit, while at the same time it is secured in the axial direction using shape-locking between a shoulder 22 on the collar 16 formed by an increase in its diameter and by a shoulder 23 on the end of the camshaft that sits against the side wall 8 of the drive member 5. It can also be seen from FIG. 1 that to design the collar 16 as a pressure medium distributor, two annular notches 24, 25 are made in the collar's exterior surface 19 that are connected to the pressure chambers 14, 15 of the device 1. One of these annular notches opens up into the center hole 30 of the collar 16 through radial holes, and the other opens into a number of axial notches 29 in the exterior surface 19 of the collar 16. There are two more annular notches 27, 28 on the exterior surface 26 of the camshaft 4 that are axially separated and that are connected to the pressure medium feed and discharge ports of the device 1. These annular notches are connected through a number of radial holes to the pressure medium channels 17, 18 in the collar 16 that are formed after the device 1 is installed on the camshaft 4 in such a way that annular notches 25 and 27 are hydraulically connected through radial notches 29 in the exterior surface 19 of the collar and annular notches 24 and 28 are hydraulically connected through the axial center hole of the collar 16. Moreover, in the embodiment shown in FIG. 1, the pressure medium feed and discharge ports of the device 1 are, for example, fed by a pressure medium console 38 connected to lubricant circuit 39 of the internal combustion engine, said console enclosing the annular notches 27, 28 in the exterior surface 26 of the camshaft 4. The steel seal rings located between the annular notches 27, 28 and at the camshaft shoulder 23, but not identified more closely, are intended to prevent internal and external pressure medium leakages when pressure medium is supplied to the device 1. Furthermore, as a means to brace against the torque applied to the fastening screw 13, FIG. 1 clearly shows that the end of the collar 16 opposite the camshaft is designed with a hexagonal head 31 on which to place an auxiliary tool. The end 21 of the collar 16 facing the camshaft is, on the other hand, itself designed as a means to center the device 1 onto the camshaft 4 by completely inserting it into a centering hole 32 in the rear 33 of the camshaft 4, the interior wall of the hole simultaneously sealing the axial notches 29 in the exterior surface 19 of the collar 16.

In contrast, the second embodiment of the device 1' designed according to the invention as illustrated in FIGS. 3 and 4 is characterized, in comparison with the first embodiment, in that the driven member 10' of the device 1' is shape-locked onto the collar 16' radially and circumferentially by a peripheral splining 34, whereas it is also shape-locked in the axial direction by means of a radial locking pin 35 between the driven member 10' and the collar 16' as seen in FIG. 3. In the design of a pressure medium distributor, the second embodiment of the device 1' also differs in the form shown in FIG. 3 in that two annular notches 24', 25' connected to the pressure chambers 14', 15' of the device 1' and two annular notches 27', 28' connected to the pressure medium feed and discharge ports of the device 1' are located on the exterior surface 19' of the collar 16' separated from one another axially. Clearly, the annular notches 25' and 27' are again hydraulically connected through a number of radial holes extending from the notches and through a number of axial holes 36 in the collar 16', whereas annular notches 24' and 28' are hydraulically connected, as in the first embodiment, through a number of radial holes and through the axial center hole 30' in the collar 16'. As in the first embodiment, this embodiment also indicates the pressure medium feed and discharge ports of the device 1', for example in the form of a pressure medium console 38' connected to the indicated lubricant circuit 39' of the internal combustion engine, with the console enclosing the annular notches 27', 28' of FIG. 3 in the exterior surface 19' of the collar 16', which are sealed from one another and from the outside by steel seal rings, which are not identified more closely. A hexagonal head 31' on which to place an auxiliary tool is formed on the end 20' of the collar 16' opposite the camshaft and a stem 37 created by a reduction in diameter is located at the end 21' of the collar 16' facing the camshaft, with the stem being inserted into a complementary centering hole 32' in the rear 33' of the camshaft 4'. These two modifications provide, moreover, in this embodiment the means to brace against the torque applied to the fastening screw 13' as well as the means to center the device 1' on the camshaft 4'.

| Reference List | |
|---|---|
| 1, 1' | Device |
| 2, 2' | End |
| 3, 3' | Cylinder Head |
| 4, 4' | Camshaft |
| 5, 5' | Drive Member |
| 6, 6' | Peripheral Wall |
| 7, 7' | Side Wall |
| 8, 8' | Side Wall |
| 9, 9' | Intermediate Walls |
| 10, 10' | Driven Member |
| 11, 11' | Hub |
| 12, 12' | Vane |
| 13, 13' | Fastening Screw |
| 14, 14' | Pressure Chambers |
| 15, 15' | Pressure Chambers |
| 16, 16' | Collar |
| 17, 17' | Pressure Medium Channels |
| 18, 18' | Pressure Medium Channels |
| 19, 19' | Exterior Surface of 16, 16' |
| 20, 20' | Ends |
| 21, 21' | Ends |
| 22, 22' | Shoulder |
| 23 | Camshaft Shoulder |
| 24, 24' | Annular notch |
| 25, 25' | Annular Notch |
| 26 | Exterior Surface of 4 |
| 27, 27' | Annular Notch |
| 28, 28' | Annular Notch |
| 29 | Axial Notches |
| 30, 30' | Center Hole |
| 31, 31' | Hexagonal head |
| 32, 32' | Centering Hole in 4, 4' |
| 33, 33' | Rear of 4, 4' |
| 34 | Splining |
| 35 | Locking Pin |
| 36 | Holes |
| 37 | Stem |
| 38, 38' | Pressure Medium Console |
| 39, 39' | Lubricant Circuit |

What is claimed is:

1. A device to change the timing of gas exchange valves in an internal combustion engine, comprising a rotating piston positioning device to adjust an angle that a camshaft is rotated relative to a crankshaft, wherein:

the device (1, 1') is located at a driven end (2, 2') of the camshaft (4, 4') supported inside a cylinder head (3, 3') of the internal combustion engine, and is a hydraulic actuator, the device (1, 1') includes a drive member (5, 5') that is drive by the crankshaft of the internal combustion engine and a driven member (10, 10') that is fixed to the camshaft (4, 4') of the internal combustion engine, at least the driven member (10, 10') of the device (1, 1') is made of a lightweight metal or plastic, and is axially bolted to the camshaft (4, 4') using central fastening screw (13, 13'), the drive member (5, 5') is radially supported external to the driven member (10, 10') as it rotates, and force is transferred from the drive member to the driven member through hydraulic pressure chambers (14, 15, 14', 15') formed inside the device (1, 1'), the pressure chambers (14, 15, 14', 15) being selectively or simultaneously chargeable with a hydraulic pressure medium, for relative rotation of or fixing of the driven member (10, 10') relative to the drive member (5, 5'), which causes the camshaft (4, 4') to do likewise with respect to the crankshaft, a fastening screw (13, 13') connecting the driven member (10, 10') to the camshaft defining a conical zone of force in which a collar (16, 16') made of a compression-resistant material is provided, and the driven member (10, 10') is at least one of shape-locked and friction-locked onto the collar axially, radially and circumferentially, to prevent deformation of the driven member upon installation on the camshaft (4, 4').

2. A device according to claim 1, wherein the collar (16, 16') located in the driven member (10, 10') is made of a steel material, and is formed as a prefabricated pressure medium distributor containing pressure medium channels (17, 18, 17', 18') that lead from pressure medium feed and discharge ports of the device (1, 1') to the respective pressure chambers (14, 15, 14', 15').

3. A device according to claim 2, wherein the collar (16, 16') includes ends (20, 21, 20', 21') that extend beyond an axial width of the device (1, 1') and an exterior surface (19, 19') of the collar outside of the driven member (10, 10') forms an external radial bearing for the driven member (5,5'), and at least one of the ends (20, 21, 20', 21') of the collar (16, 16') includes a means on one side to brace against torque applied to the fastening screw (13, 13') and the other of the ends includes a means to center the device (1, 1') on the camshaft (4, 4').

4. A device according to claim 3, wherein the driven member (10) of the device (1) is frictionally locked onto the collar (16) radially and circumferentially using a press fit, and is also secured in an axial direction between a shoulder (22) on the collar (16) formed by an increase in diameter and by a shoulder (23) on an end of the camshaft that sits flush against the drive member (5).

5. A device according to claim 4, wherein two annular notches (24, 25) are located on an exterior surface of the collar (16) that are connected to the pressure chambers (14, 15) of the device (1) and two annular notches (27, 28) are located on an exterior surface (26) of the camshaft (4) that are axially separated and are connected to pressure medium feed an discharge ports of the device (1), a first of the collar and camshaft annular notches (25, 27), respectively, are hydraulically connected through a plurality of axial notches (29) in the exterior surface (19) of the collar (16) and a second of the collar and camshaft annular notches (24, 28), respectively, are hydraulically connected through an axial center hole (30) of the collar (16).

6. A device according to claim 4, wherein an end (20) of the collar (16) opposite the camshaft include a hexagonal head (31) adapted to receive an auxiliary tool as a means to brace against torque applied to the fastening screw (13), and an end (21) of the collar (16) facing the camshaft includes a means to center the device (1) on the camshaft (4), adapted for insertion into a complementary centering hole (32) in an end (33) of the camshaft (4).

7. A device according to claim 3, wherein the driven member (10') of the device (1') is shape-locked into the collar (16') radially and circumferentially by a peripheral splining (34), and is secured in an axial direction by a radial locking pin (35) between the driven member (10') and the collar (16').

8. A device according to claim 7, wherein two annular notches (24', 25') are located on an exterior surface (19') of the collar (16') and are connected to the pressure chambers (14', 15') of the device (1'), and two annular notches (27', 28') are located on the camshaft and are connected to pressure medium feed and discharge ports of the device (1'), separated from one another axially, a first of the collar and camshaft annular notches(25', 27'), respectively, are hydraulically connected through a number of axial holes (36) in the collar (16'), and a second of the collar and camshaft annular notches (24', 28') respectively, are hydraulically connected through an axial center hole (30') in the collar (16').

9. A device according to claim 7, wherein an end (20') of the collar (16') opposite the camshaft include a hexagonal head (31') adapted to receive an auxiliary tool as a means to brace against torque applied to the fastening screw (13'), and an end (21') of the collar (16') facing the camshaft includes a stem (37) created by a reduction in diameter to center the device (1') on the camshaft 4'), the stem being inserted into a complementary centering hole (32') in an end (33') of the camshaft (4').

* * * * *